US011959727B1

(12) United States Patent
Yedor et al.

(10) Patent No.: US 11,959,727 B1
(45) Date of Patent: Apr. 16, 2024

(54) SYSTEMS AND METHODS FOR FIREARM SIGHT MOUNTING PLATES

(71) Applicant: Agency Arms LLC, Ventura, CA (US)

(72) Inventors: Max Yedor, Ventura, CA (US); Eric Chang, Ventura, CA (US)

(73) Assignee: Agency Arms LLC, Ventura, CA (US)

( * ) Notice: Subject to any disclaimer, the term of this patent is extended or adjusted under 35 U.S.C. 154(b) by 0 days.

(21) Appl. No.: 17/827,839

(22) Filed: May 30, 2022

Related U.S. Application Data

(60) Provisional application No. 63/196,061, filed on Jun. 2, 2021, provisional application No. 63/195,387, filed on Jun. 1, 2021.

(51) Int. Cl.
*F41G 11/00* (2006.01)
*F41G 1/26* (2006.01)

(52) U.S. Cl.
CPC ..... *F41G 11/003* (2013.01); *F41G 1/26* (2013.01)

(58) Field of Classification Search
CPC ..... F41G 1/26; F41G 11/003
USPC ..... 42/148
See application file for complete search history.

(56) References Cited

U.S. PATENT DOCUMENTS 4,628,611 A * 12/1986 Ruffino ..... F41G 1/16 42/137
5,467,552 A 11/1995 Cupp et al.
6,327,806 B1 12/2001 Paige
8,011,130 B2 * 9/2011 Chang ..... F41G 11/002 89/41.17
8,832,983 B1 9/2014 Wolf
8,893,422 B2 11/2014 Wolf
9,062,936 B2 6/2015 Zimmer
9,267,759 B2 2/2016 Speroni
9,506,726 B2 11/2016 Wolf
9,587,911 B2 3/2017 Wolf
10,024,628 B2 7/2018 Toner et al.
10,036,613 B2 7/2018 Huff
RE47,335 E 4/2019 Wolf
10,352,654 B2 7/2019 Costet et al.
10,663,254 B1 5/2020 Molcho
10,753,710 B2 8/2020 Niswander et al.
11,112,214 B2 * 9/2021 Niswander ..... F41G 11/001
11,280,587 B2 3/2022 Niswander et al.
2013/0111799 A1 5/2013 Lee et al.
2014/0150325 A1 6/2014 Keng et al.
(Continued)

OTHER PUBLICATIONS

ATEI, Works in progress, Trijicon, Inc., Dec. 1, 2011 (1 p.).
(Continued)

*Primary Examiner* — John Cooper
(74) *Attorney, Agent, or Firm* — Eversheds Sutherland (US) LLP

(57) ABSTRACT

A firearm mounting plate assembly is provided. The firearm mounting plate assembly includes a firearm slide with a first side, a second side, and a top side. A recess defined by a first slide wall and a recess base surface is disposed on the firearm slide top side. The recess includes a rib. The firearm mounting plate assembly includes a mounting plate with a top surface, a bottom surface, a front side, and a rear side. The mounting plate includes one or more bosses. The mounting plate is configured to secure within the recess of the firearm slide.

20 Claims, 13 Drawing Sheets

(56) References Cited

U.S. PATENT DOCUMENTS

| | | | | |
|---|---|---|---|---|
| 2014/0230305 | A1* | 8/2014 | Zimmer | F41C 3/00 42/111 |
| 2015/0198415 | A1 | 7/2015 | Campean | |
| 2015/0241175 | A1* | 8/2015 | Wolf | F41G 11/005 42/124 |
| 2017/0059277 | A1 | 3/2017 | Justic | |
| 2018/0087871 | A1* | 3/2018 | Toner | F41G 1/16 |
| 2019/0049217 | A1* | 2/2019 | Costet | F41G 1/16 |
| 2019/0257620 | A1* | 8/2019 | Zimmer | F41C 3/00 |
| 2020/0025520 | A1* | 1/2020 | Niswander | F41G 11/003 |
| 2021/0348882 | A1 | 11/2021 | Niswander et al. | |
| 2022/0316801 | A1 | 5/2022 | Niswander et al. | |

OTHER PUBLICATIONS

GW Leupold Deltapoint Cut, https://web.archive.org/web/20110104073915/http://www.glockworx.com:80/Products.aspx?CAT=3699, Jan. 2011 (3 pp.).

Goteron, N/A, lightfighter.net (image of a unity tactical device), Feb. 1, 2012 (1 p.).

Matt, "Dueck Defense RBU", Sep. 26, 2015, Jerking the Trigger, Online Article, All Pages <https://jerkingthetrigger.com/2015/09/26/dueck-defense-rbu/>. (Year:2015).

Moden Weapon Concepts, "Pistol Red Dot Mounting Alternative: Dueck Defense RBU (Trijicon RMR)", Mar. 3, 2016, YouTube, Online Video, Entire Video, <https://www.youtube.com/watch?v=0Jdb0ohwMTc>. (Year: 2016).

* cited by examiner

SYSTEMS AND METHODS FOR FIREARM SIGHT MOUNTING PLATES

CROSS REFERENCE TO RELATED APPLICATIONS

This application claims benefit of priority to U.S. Provisional Patent Application No. 63/195,387 filed Jun. 1, 2021 and U.S. Provisional Patent Application No. 63/196,061, filed Jun. 2, 2021, which are incorporated hereby by reference in their entirety.

TECHNICAL FIELD

The present application relates generally to firearm sight mounting plates.

BACKGROUND

Red dot sights have become more and more prevalent for firearms. Red dot sights provide an illuminated aiming dot that is parallax free. As may be desired from time to time, the configuration of a red dot sight on a firearm may vary based on personal preference and/or application. For instance, in some configurations, the red dot is in front of the rear iron sight. In other configurations, the red dot sight may be behind the rear iron sight. Yet further, in some configurations, the iron sight may be removed (e.g., not present) or may be the only sight coupled to the firearm. In still other configurations, suppressor height iron sights may be utilized. However, if a shooter wants to change from one configuration to another, or from one red dot sight to another, such change may be difficult, time-consuming, require special tools, and/or not possible.

BRIEF DESCRIPTION OF THE DRAWINGS

The detailed description is set forth with reference to the accompanying drawings illustrating examples of the disclosure, in which use of the same reference numerals indicates similar or identical items. Certain examples of the present disclosure may include elements, components, and/or configurations other than those illustrated in the drawings, and some of the elements, components, and/or configurations illustrated in the drawings may not be present in certain examples.

DETAILED DESCRIPTION

The present disclosure provides for a firearm sight mounting plate assembly, which includes a mounting plate (also referred to herein as a firearm sight mounting plate) and a firearm slide with a recess configured to receive the mounting plate. In this manner, the size, shape, and configuration of the recess may correspond to the size, shape, and configuration of the mounting plate. The mounting plate may be adapted to mount several different types of red dot sights and/or iron sights thereon. The mounting plate may be a universal mount for different red dot sights, such as Trijicon® sights, TRUGLO® sights, Burris® sights, or sights from other manufacturers. For example, the mounting plate may include one or more apertures by which fasteners penetrate through the mounting plate into the firearm slide to secure the mounting plate to the firearm slide. The mounting plate may have a plurality of protrusions and/or apertures configured to further secure a red dot sight onto the mounting plate. The mounting plate may also have a dovetail slot or other mounting feature for receiving a rear iron sight. In some instances, the dovetail slot may be on the front side or rear side of the mounting plate. In some instances, the rear iron sight may be positioned in front of or behind the red dot sight. In other instances, the red dot sight may be omitted, and the mounting plate may only include an iron sight mounted thereto.

The disclosure now will be described more fully hereinafter with reference to the accompanying drawings, in which exemplary embodiments are shown. The concepts discussed herein may, however, be embodied in many different forms and should not be construed as limited to the examples set forth herein; rather, these examples are provided so that this disclosure will be thorough and complete, and will fully convey the scope to those of ordinary skill in the art. Like numbers refer to like, but not necessarily the same or identical, elements throughout.

Figure 1:
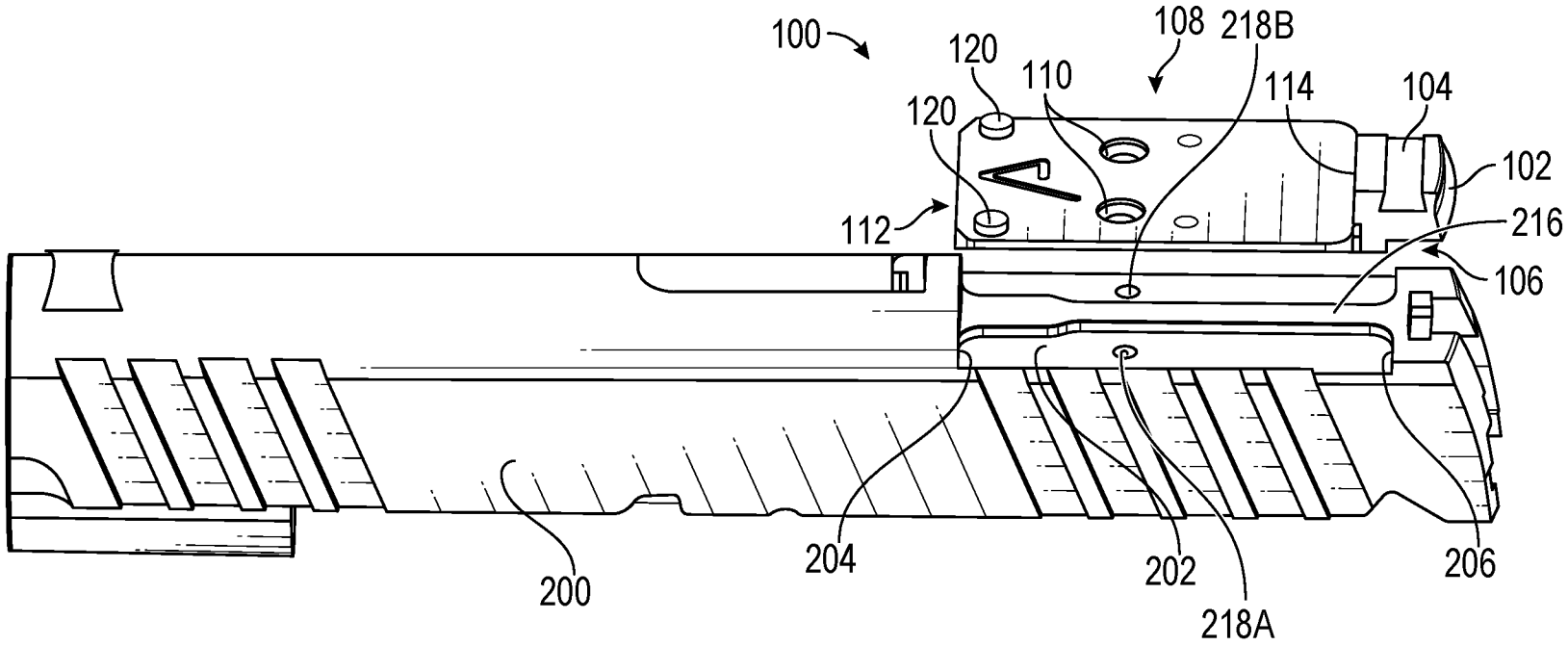
FIG. 1 is a front-side perspective view of a firearm sight mounting plate assembly in a disengaged position according to one or more examples of the disclosure.
Figure 2:
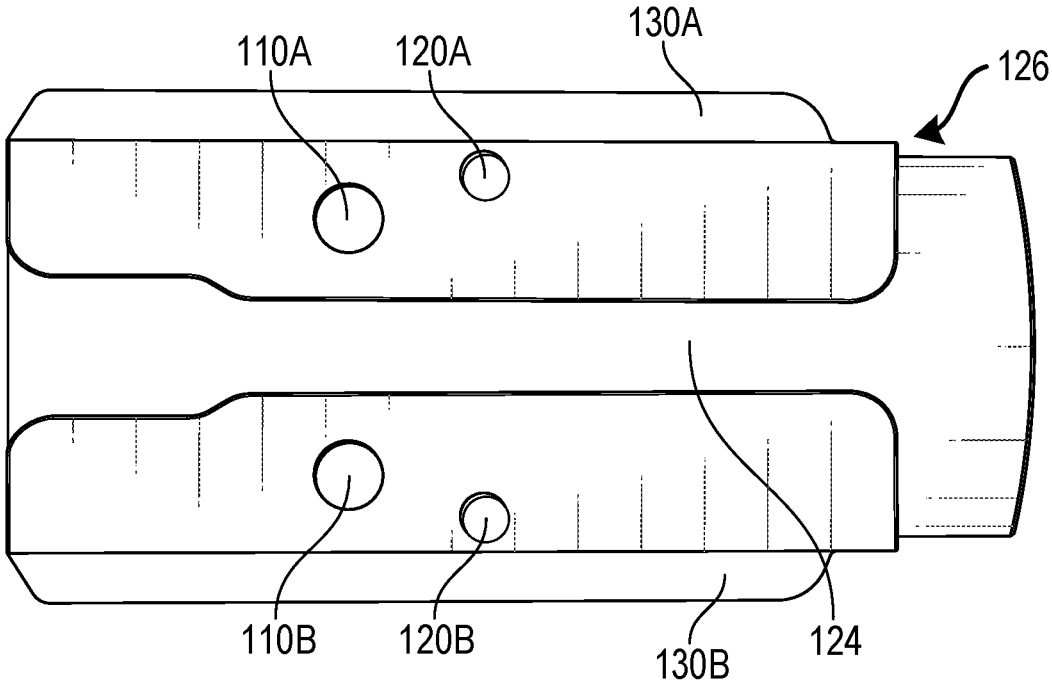
FIG. 2 is a bottom view of the mounting plate according to one or more examples in the disclosure.
Figure 3:
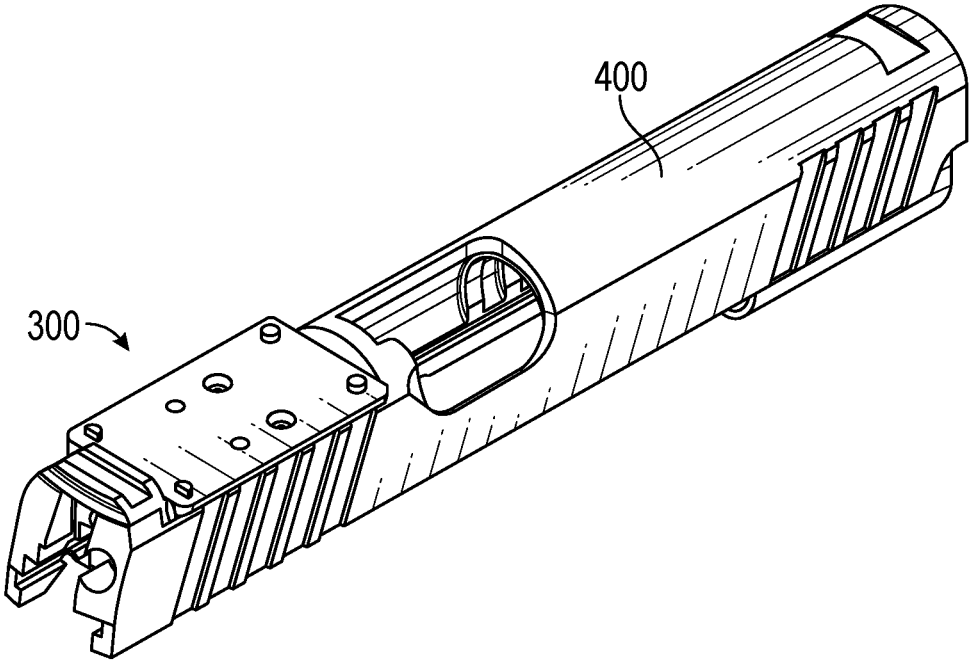
FIG. 3 is a side-perspective view of the mounting plate with firearm slide according to one or more examples in the disclosure.
Figure 4:
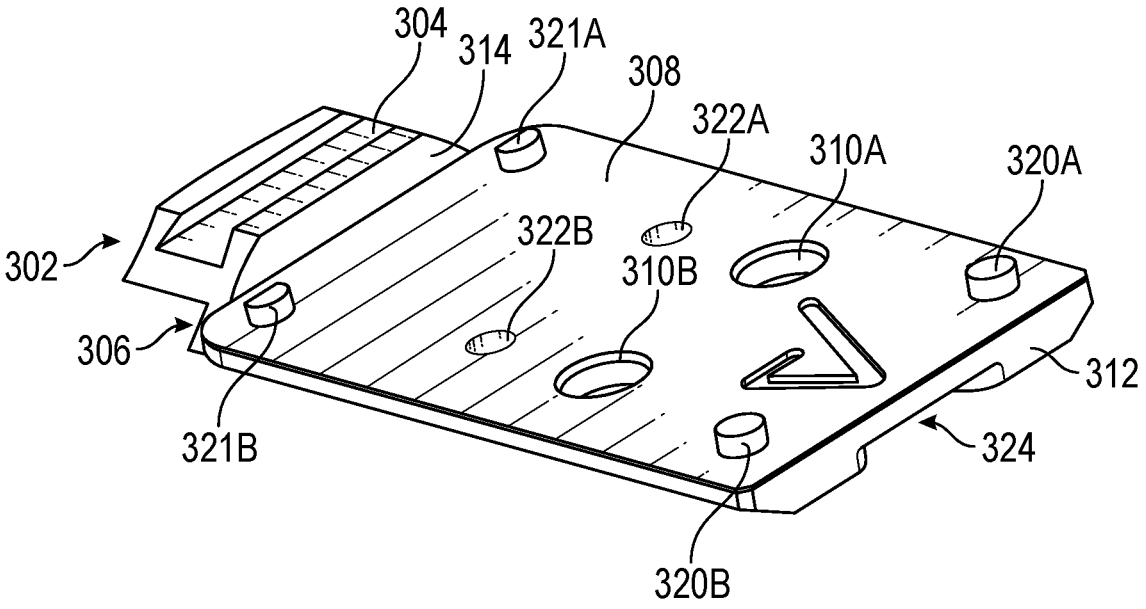
FIG. 4 is a perspective view of the mounting plate according to one or more examples in the disclosure.

Referring to FIGS. 1-2, a firearm slide 200 has a recess 202 on the top side of the slide configured to accept a mounting plate 100. In certain examples, the firearm slide includes an exterior surface with a front side and a back side. On a top side of the firearm slide, between the front side and the back side, the recess 202 is disposed towards the back side. The recess can be a recessed surface along the plane of the top side of the firearm slide.

The recess of the firearm slide includes slide walls (e.g., a first slide wall 204 at a front of the recess and a second slide wall 206 at a rear of the recess) disposed opposite to one another, forming a recess surface between the slide walls. Extending from a slide wall can be a rib 216 disposed within the recess. The rib 216 can run between the first slide wall 204 and second slide wall 206. In other configurations, the rib 216 may run between the first slide wall 204 and any point along the recess 202. The rib 216 can be a continuous or non-continuous raised surface from a recess base surface configured to correspond to a later discussed channel 124 of a mounting plate. In other examples, the rib 216 may extend in a variety of other directions and/or take other shapes, such as a square, circle, triangle, etc., or a combination shape. The first slide wall 204 and second slide wall 206 may be vertical walls to accompany the front 112 and ridge 106 of the mounting plate 100.

In some examples, a first firearm slide socket 218A and a second firearm slide socket 218B may be disposed about and adjacent to the recess. The sockets 218A, 218B can be disposed throughout and adjacent to the recess. The sockets 218A, 218B can be configured to receive one or more fasteners (e.g., threaded). The first socket 218A of the slide 200 may align with a first socket 110A of the plate 100 and the second socket 218B of the slide 200 may align with the second socket 110B of the plate 100 such that a fastener is expended through socket 110A, into socket 218A to secure the mounting plate to the slide. The firearm plate mounting assembly can alter between a disengaged position and an engaged position. In the disengaged position, the mounting plate (or any mounting plate embodiment shown or described herein) can lower into the recess 202 to secure onto the slide.

Figure 5:
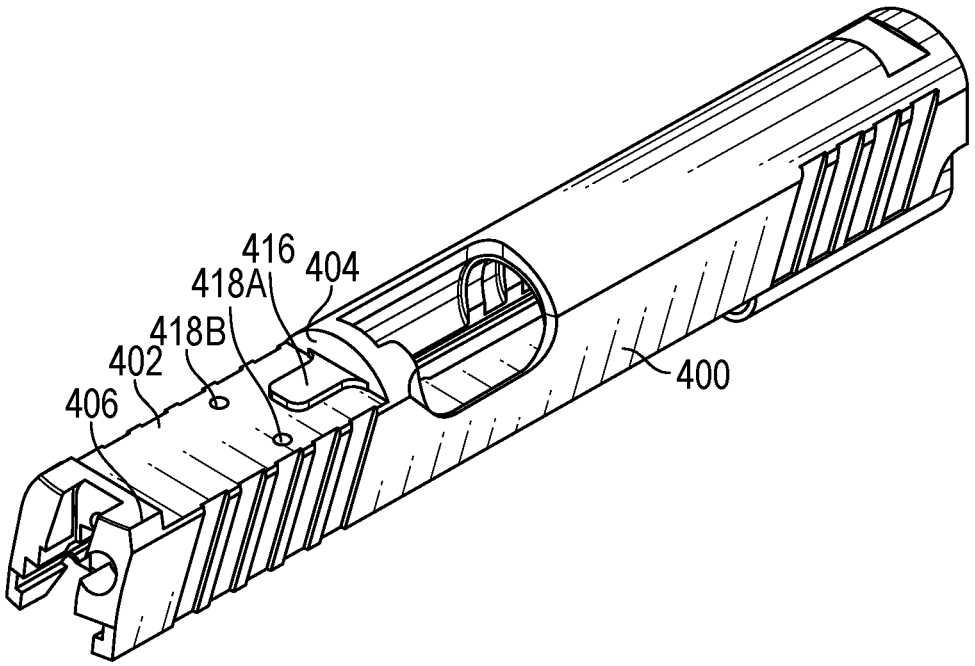
FIG. 5 is a perspective view of the slide according to one or more examples in the disclosure.
Figure 6:
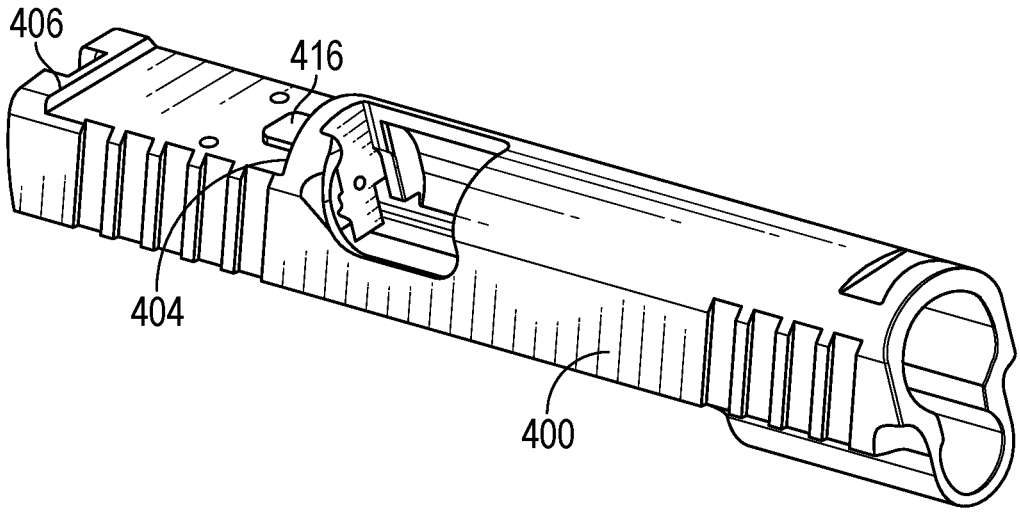
FIG. 6 is a perspective view of the slide according to one or more examples in the disclosure.

The mounting plate can include an optic base surface 108 with engagement components such as a sight joint 104, one or more tabs, one or more bosses 120A, 120B, and sockets 110A, 110B disposed thereon. In one example, the sight joint 104 is disposed adjacent to the rear side 102, opposite the front side 112, and a first plate wall 114. The sight joint 104 can be shaped like a dovetail sight joint and thereby secure a complementing iron sight. The sight joint 104 may be raised above the recess 202 of the slide as well as the optic base 108 of the mounting plate. The ridge 106 may extend from the bottom surface 126 of the mounting plate to the bottom of the sight joint 104. The optic base surface can have one or more mounting plate sockets 110A, 110B in front of the first plate wall 114. The one or more sockets 110A, 110B described herein may be placed anywhere along the optic base surface and align with sockets 218A, 218B disposed on the firearm slide. The socket 110 can be hollow with an aperture to thereby receive a fastener. That is, the socket 110 can extend from the top surface to the bottom surface 126 of the mounting plate. In some examples, the fastener may extend through the optic (not shown) through the socket 110, and into the firearm slide socket 218 once the mounting plate is set onto the firearm slide. In other examples, the socket 110 may not have an aperture. The bottom surface 126 of the mounting plate 100 may further have a channel 124 to correspond to the rib 216 of the slide 200, as well as wings 130A, 130B on the right and left sides of the mounting plate 100. The channel 124 may extend from the front side 112 of the mounting plate to the ridge 106. The channel 124 may further be variable or change in width to accompany the rib 216 of the slide, or to accompany multiple different types of ribs (i.e., the bottom surface 126 of mounting plate 100 would also fit with the shorter rib of slide 400 as shown in FIG. 5). The wings 130A, 130B may be thinner than the rest of the mounting plate 100 and allow for easy grip and removal of the mounting plate 100 by grabbing the sides.

Referring to FIGS. 3-7, a firearm slide 400 has a recess 402 configured to accept a mounting plate 300. In certain examples, the firearm slide includes an exterior surface with a front side and a back side. On a top side of the firearm slide, between the front side and the back side, the recess 402 is disposed towards the second back side. The recess can be a recessed surface along the plane of the top side of the firearm slide.

The recess of the firearm slide includes slide walls (e.g., a first slide wall 404 at a front of the recess and a second slide wall 406 at a rear of the recess) disposed opposite to one another. Extending from a slide wall can be a rib 416 disposed within the recess. The rib 416 can run from the first slide wall 404 and stop before the second slide wall 406. The rib 416 can be a continuous raised surface from a recess base surface configured to correspond to a later discussed channel 324 of a mounting plate. In other examples, the rib 416 may extend in a variety of other directions and/or take other shapes, such as a square, circle, triangle, etc., or a combination shape. The first slide wall 404 may be a vertical wall to accompany the front 312 of the mounting plate 300. The second slide wall 406 may be a dovetail slot to accompany the dovetail cut ridge 306 of the mounting plate.

In some examples, a first socket 418A and a second socket 418B may be disposed about and adjacent to the recess. The sockets 418A, 418B can be disposed throughout and adjacent to the recess. The sockets 418A, 418B can be configured to receive one or more fasteners (e.g., threaded). The first socket 418A of the slide 400 may align with a first socket 310A of the plate 300 and the second socket 418B of the slide 400 may align with the second socket 310B of the plate 300 such that a fastener is expended through socket 310A, into socket 418A to secure the mounting plate to the slide. The firearm plate mounting assembly can alter between a disengaged position and an engaged position. In the disengaged position, the mounting plate (or any mounting plate embodiment shown or described herein) can lower into the recess 402 to secure onto the slide.

The mounting plate can include an optic base surface 308 with engagement components such as a sight joint 304, one or more tabs 321A, 321B, one or more bosses 320A, 320B, and sockets 310A, 310B disposed thereon. The tabs 321A, 321B may help secure an optic, laser, sight, or other accessory onto the mounting plate 300. The ridge 306 may be cut in a dovetail in order to couple with the second slide wall 406. In such a configuration, the second slide wall 406, due to the shape, may prevent the mounting plate 300 from being dropped straight down into place. In this configuration, the mounting plate 300 may be moved from the disengaged position to the engaged position by tilting the mounting plate and sliding the ridge 306 rearward and downward such that the ridge 306 slides against the second slide wall 406, and then releasing the plate so that the rib 416 fits into the channel 324 of the mounting plate 300. In one example, the sight joint 304 is disposed adjacent to the rear side 302, opposite the front side 312, and a first plate wall 314. The sight joint 304 can be shaped like a dovetail sight joint and thereby secure a complementing iron sight. The sight joint 304 may be raised above the recess 402 of the slide as well as the optic base 308 of the mounting plate. The optic base surface can have one or more sockets 310A, 310B in front of the first plate wall 314. The one or more sockets 310A, 310B described herein may be placed anywhere along the optic base surface and align with sockets 418A, 418B disposed on the firearm slide. The socket 310 can be hollow with an aperture to thereby receive a fastener. That is, the socket 310 can extend from the top surface to the bottom surface 326 of the mounting plate. In some examples, the fastener may extend through the optic (not shown) through the socket 310, and into the firearm slide socket 318 once the mounting plate is set onto the firearm slide. In other examples, the socket 310 may not have an aperture. The bottom surface 326 of the mounting plate 300 may further have a channel 324 to correspond to the rib 416 of the slide 400, as well as wings 330A, 330B on the right and left sides of the mounting plate 300. The channel 324 may extend from the front side 312 of the mounting plate to the ridge 306. The channel 324 may further be variable or change in width to accompany the rib 316 of the slide, or to accompany multiple different types of ribs (i.e., the bottom surface 326 of mounting plate 300 would also fit with the longer rib of slide 200). The wings 330A, 330B may be thinner than the rest of the mounting plate 300 and allow for easy grip and removal of the mounting plate 300 by grabbing the sides.

Referring to FIGS. 8-9, and 18-19, a firearm slide 600 has a recess 602 configured to accept a mounting plate 500. In certain examples, the firearm slide includes an exterior surface with a front side and a back side. On a top side of the firearm slide, between the front side and the back side, the recess 602 is disposed towards the second back side. The recess can be a recessed surface along the plane of the top side of the firearm slide.

The recess of the firearm slide includes slide walls (e.g., a first slide wall 604 at a front of the recess and a second slide wall 606 at a rear of the recess) disposed opposite to one another. Extending from a slide wall can be a rib 616 disposed within the recess. The rib 616 can run from the first slide wall 604 and stop before the second side wall 606. The rib 616 can be a continuous raised surface from a recess base surface configured to correspond to a later discussed channel 524 of a mounting plate. In other examples, the rib 616 may extend in a variety of other directions and/or take other shapes, such as a square, circle, triangle, etc., or a combination shape. The first slide wall 604 may be a dovetail slot to accompany a dovetail 531 on the front 512 of the mounting plate 500. The second slide wall 606 may be a flat wall to accompany the vertical ridge 506 of the mounting plate 500.

The firearm plate mounting assembly can alter between a disengaged position and an engaged position. In the disengaged position, the mounting plate (or any mounting plate embodiment shown or described herein) can lower into the recess 402 to secure onto the slide.

The mounting plate can include an optic base surface 508 with engagement components such as a sight joint 504, one or more tabs 521A, 521B, one or more bosses 520A, 520B, and sockets 510A, 510B disposed thereon. The tabs 521A, 521B may help secure an optic, laser, sight, or other accessory onto the mounting plate 500. The ridge 506 may be a vertical wall in order to couple with the second slide wall 406. In one embodiment, the first slide wall 404, due to the dovetail shape, may prevent the mounting plate 500 from being dropped straight down into place. In this configuration, the mounting plate 500 may be moved from the disengaged position to the engaged position by tilting the mounting plate and sliding the dovetail 531 forward and downward such that the dovetail 531 slides against the first slide wall 404, and then releasing the plate so that the rib 616 fits into the channel 524 of the mounting plate 500. In one example, the sight joint 504 is disposed adjacent to the rear side 502, opposite the front side 512, and a first plate wall 514. The sight joint 504 can be shaped like a dovetail sight joint and thereby secure a complementing iron sight. The sight joint 504 may be raised above the recess 602 of the slide as well as the optic base 508 of the mounting plate. The optic base surface can have one or more sockets 510A, 510B in front of the first plate wall 514. The one or more sockets 310A, 310B described herein may be placed anywhere along the optic base surface. The socket 510 can be hollow with an aperture to thereby receive a fastener. That is, the socket 510 can extend from the top surface to the bottom surface 526 of the mounting plate. In some examples, the fastener may extend through the optic (not shown) through the socket 510 once the mounting plate is set onto the firearm slide. In other examples, the socket 510 may not have an aperture. The bottom surface 526 of the mounting plate 500 may further have a channel 524 to correspond to the rib 616 of the slide 600, as well as wings 530A, 530B on the right and left sides of the mounting plate 500. The channel 524 may extend from the front side 512 of the mounting plate, just behind the dovetail 531, to the ridge 506. The channel 524 may further be variable or change in width to accompany the rib 616 of the slide, or to accompany multiple different types of ribs. The wings 530A, 530B may be thinner than the rest of the mounting plate 500 and allow for easy grip and removal of the mounting plate 500 by grabbing the sides.

Figure 7:
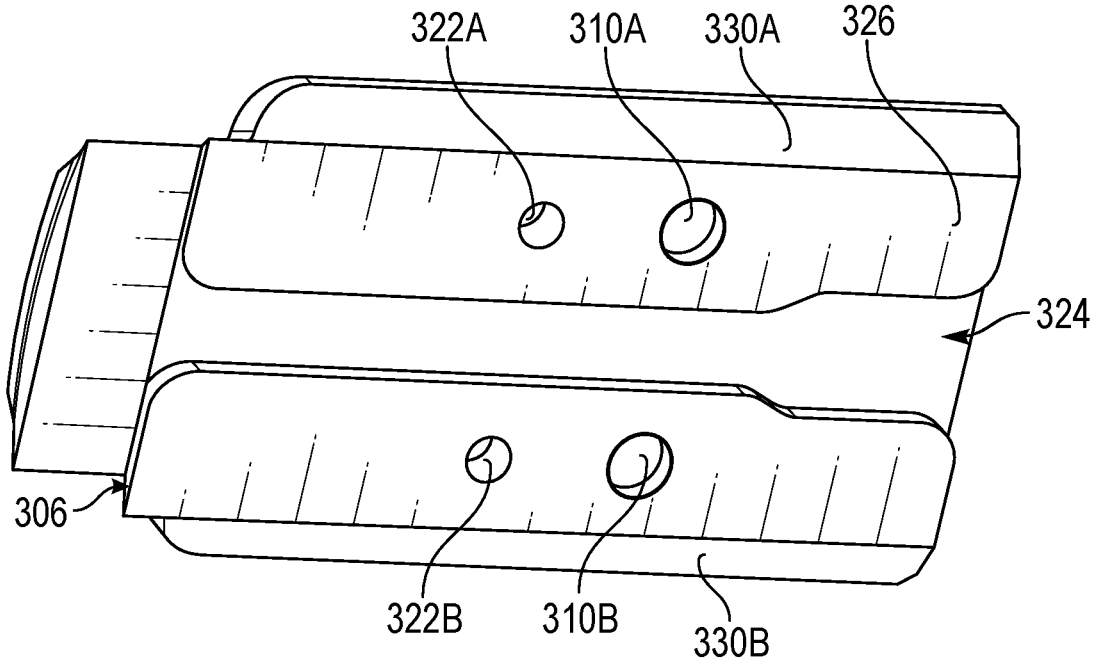
FIG. 7 is a bottom view of the slide according to one or more examples in the disclosure.
Figure 8:
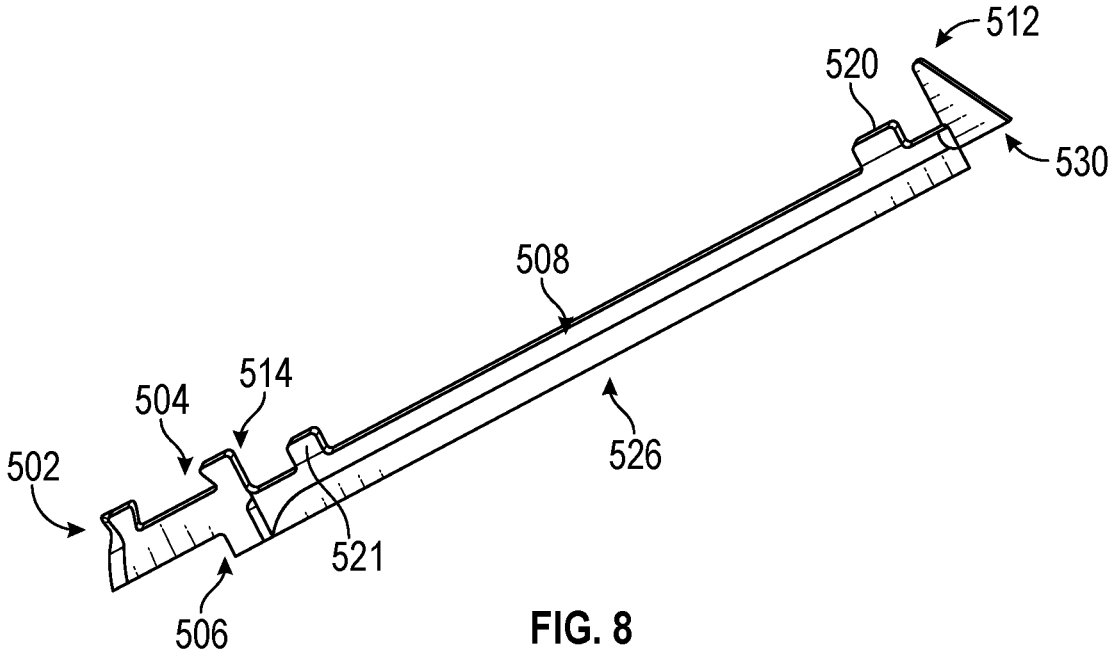
FIG. 8 is a side view of the slide with a dovetail on the front according to one or more examples in the disclosure.
Figure 9:
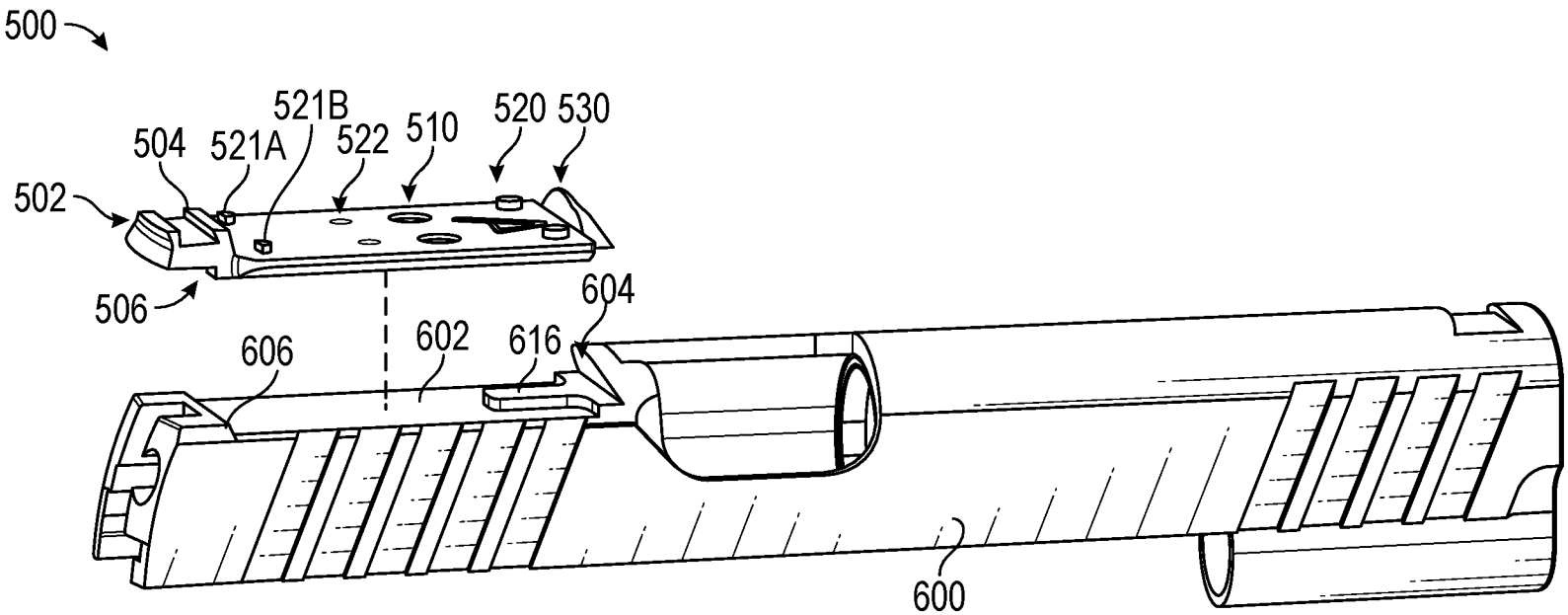
FIG. 9 is a perspective view of the slide and mounting plate with dovetail on the front of the slide according to one or more examples in the disclosure.
Figure 10:
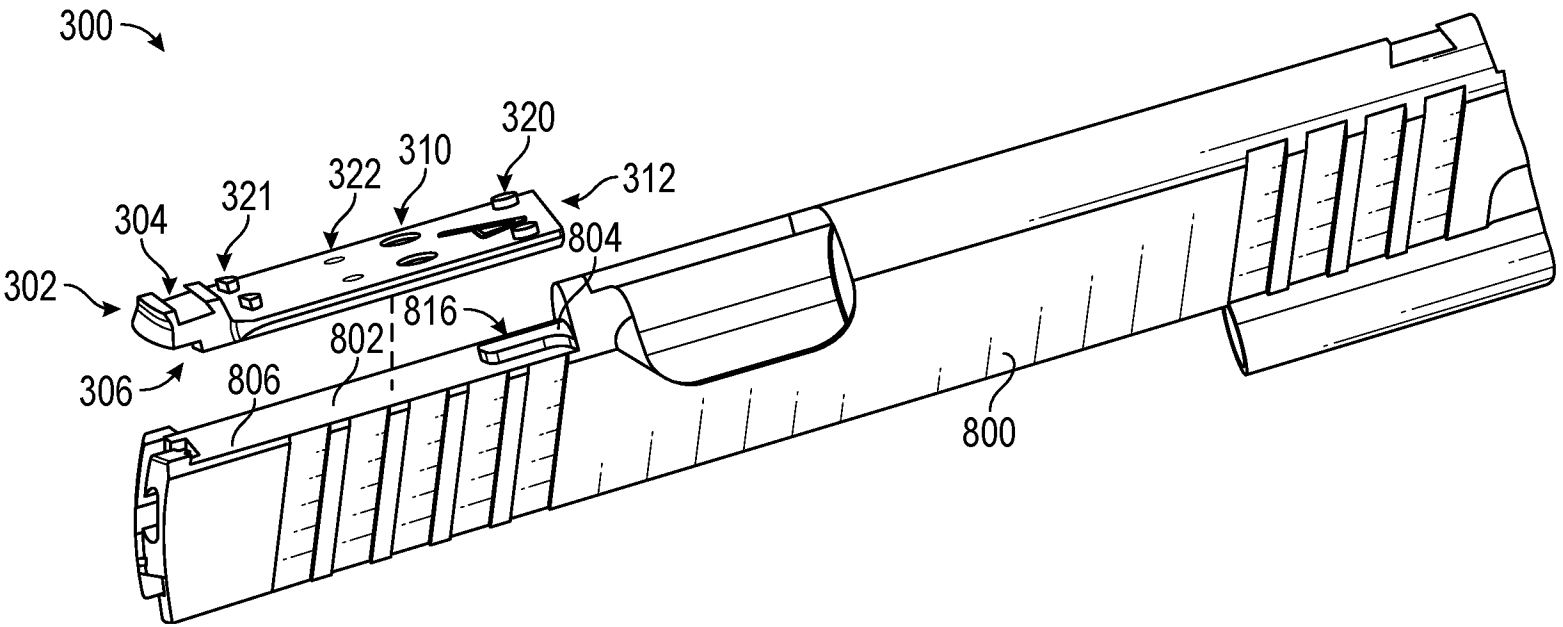
FIG. 10 is a perspective view of the mounting plate and slide with the dovetail on the rear of the slide according to one or more examples in the disclosure.
Figure 11:
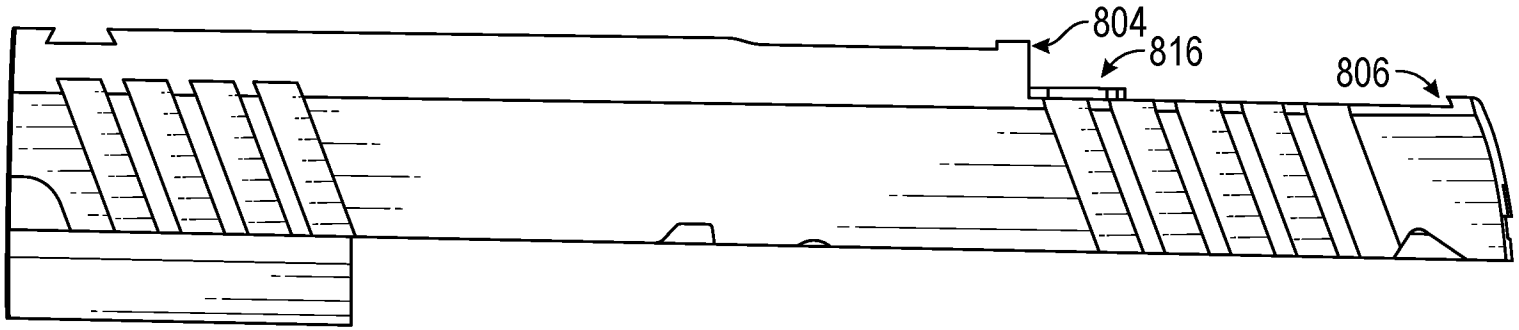
FIG. 11 is a side view of the slide with a dovetail cut according to one or more examples in the disclosure.

Referring to FIGS. 7, and 10-11, a firearm slide 800 has a recess 802 configured to accept a mounting plate 300. In certain examples, the firearm slide includes an exterior surface with a first side and a second side. In certain examples, the firearm slide includes an exterior surface with a front side and a back side. On a top side of the firearm slide, between the front side and the back side, the recess 802 is disposed towards the second back side. The recess can be a recessed surface along the plane of the top side of the firearm slide.

The recess of the firearm slide includes slide walls (e.g., a first slide wall 804 at a front of the recess and a second slide wall 806 at a rear of the recess) disposed opposite to one another. Extending from a slide wall can be a rib 816 disposed within the recess. The rib 816 can run from the first slide wall 804 and stop before the second side wall 806. The rib 816 can be a continuous raised surface from a recess base surface configured to correspond to a 324 of a mounting plate. In other examples, the rib 816 may extend in a variety of other directions and/or take other shapes, such as a square, circle, triangle, etc., or a combination shape. The first slide wall 804 may be a vertical wall to accompany the front 312 of the mounting plate 300. The second slide wall 806 may be a dovetail slot to accompany the dovetail cut ridge 306 of the mounting plate.

The firearm plate mounting assembly can alter between a disengaged position and an engaged position. In the disengaged position, the mounting plate (or any mounting plate embodiment shown or described herein) can lower into the recess 402 to secure onto the slide.

The mounting plate can include an optic base surface 308 with engagement components such as a sight joint 304, one or more tabs 321A, 321B, one or more bosses 320A, 320B, and sockets 310A, 310B disposed thereon. The tabs 321A, 321B may help secure an optic, laser, sight, or other accessory onto the mounting plate 300. The ridge 306 may be cut in a dovetail in order to couple with the second slide wall 806. In such a configuration, the second slide wall 806, due to the shape, may prevent the mounting plate 300 from being dropped straight down into place. In this configuration, the mounting plate 300 may be moved from the disengaged position to the engaged position by tilting the mounting plate and sliding the ridge 306 rearward and downward such that the ridge 306 slides against the second slide wall 806, and then releasing the plate so that the rib 816 fits into the channel 324 of the mounting plate 300. In one example, the sight joint 304 is disposed adjacent to the rear side 302, opposite the front side 312, and a first plate wall 314. The sight joint 304 can be shaped like a dovetail sight joint and thereby secure a complementing iron sight. The sight joint 304 may be raised above the recess 802 of the slide as well as the optic base 308 of the mounting plate. The optic base surface can have one or more sockets 310A, 310B in front of the first plate wall 314. The one or more sockets 310A, 310B described herein may be placed anywhere along the optic base surface. The socket 310 can be hollow with an aperture to thereby receive a fastener. That is, the socket 310 can extend from the top surface to the bottom surface 326 of the mounting plate. In some examples, the fastener may extend through the optic (not shown) through the socket 310, and into the firearm slide socket 318 once the mounting plate is set onto the firearm slide. In other examples, the socket 310 may not have an aperture. The bottom surface 326 of the mounting plate 300 may further have a channel 324 to correspond to the rib 816 of the slide 800, as well as wings 330A, 330B on the right and left sides of the mounting plate 300. The channel 324 may extend from the front side 312 of the mounting plate to the ridge 306. The channel 324 may further be variable or change in width to accompany the rib 316 of the slide, or to accompany multiple different types of ribs (i.e., the bottom surface 326 of mounting plate 300 would also fit with the longer rib of slide 200). The wings 330A, 330B may be thinner than the rest of the mounting plate 300 and allow for easy grip and removal of the mounting plate 300 by grabbing the sides.

Figure 12:
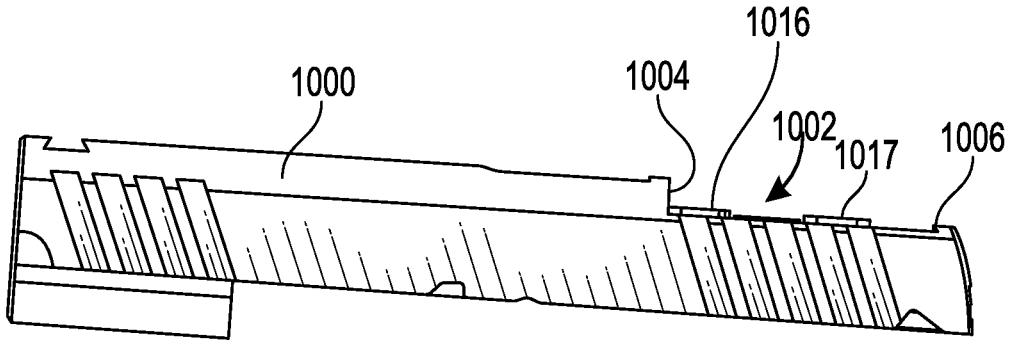
FIG. 12 is a side view of the slide with a dovetail cut and a non-continuous alignment rib according to one or more examples in the disclosure.
Figure 13:
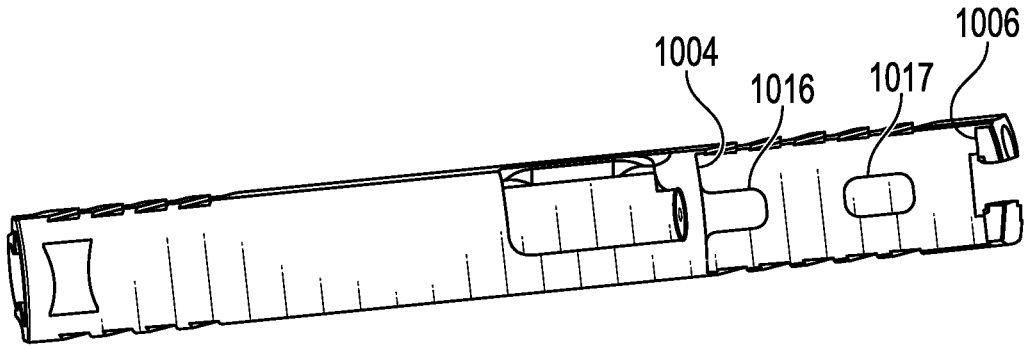
FIG. 13 is a top view of the slide with a dovetail cut and a non-continuous alignment rib according to one or more examples in the disclosure.

Referring to FIGS. 12-13, a firearm slide 1000 has a recess 1002 configured to accept a mounting plate. In certain examples, the firearm slide includes an exterior surface with a front side and a back side. On a top side of the firearm slide, between the front side and the back side, the recess 1002 is disposed towards the second back side. The recess can be a recessed surface along the plane of the top side of the firearm slide.

The recess of the firearm slide includes slide walls (e.g., a first slide wall 1004 at a front of the recess and a second slide wall 1006 at a rear of the recess) disposed opposite to one another. Extending from a slide wall can be a noncontiguous rib 1016, 1017 disposed within the recess. The first portion 1016 of the rib can run from the first slide wall 1004 and stop before the second side wall 1006, and the second portion 1017 of the rib can extend from any portion of the recess 1002 to any further portion of the recess 1002. The first portion of the rib 1016 and second portion 1017 of the rib can be a raised surface from a recess base surface configured to correspond to a channel of a mounting plate. The first slide wall 1004 may be a vertical wall to accompany the front of the mounting plate. The second slide wall 1006 may be a dovetail slot to accompany the dovetail cut ridge of the mounting plate.

Figure 14:
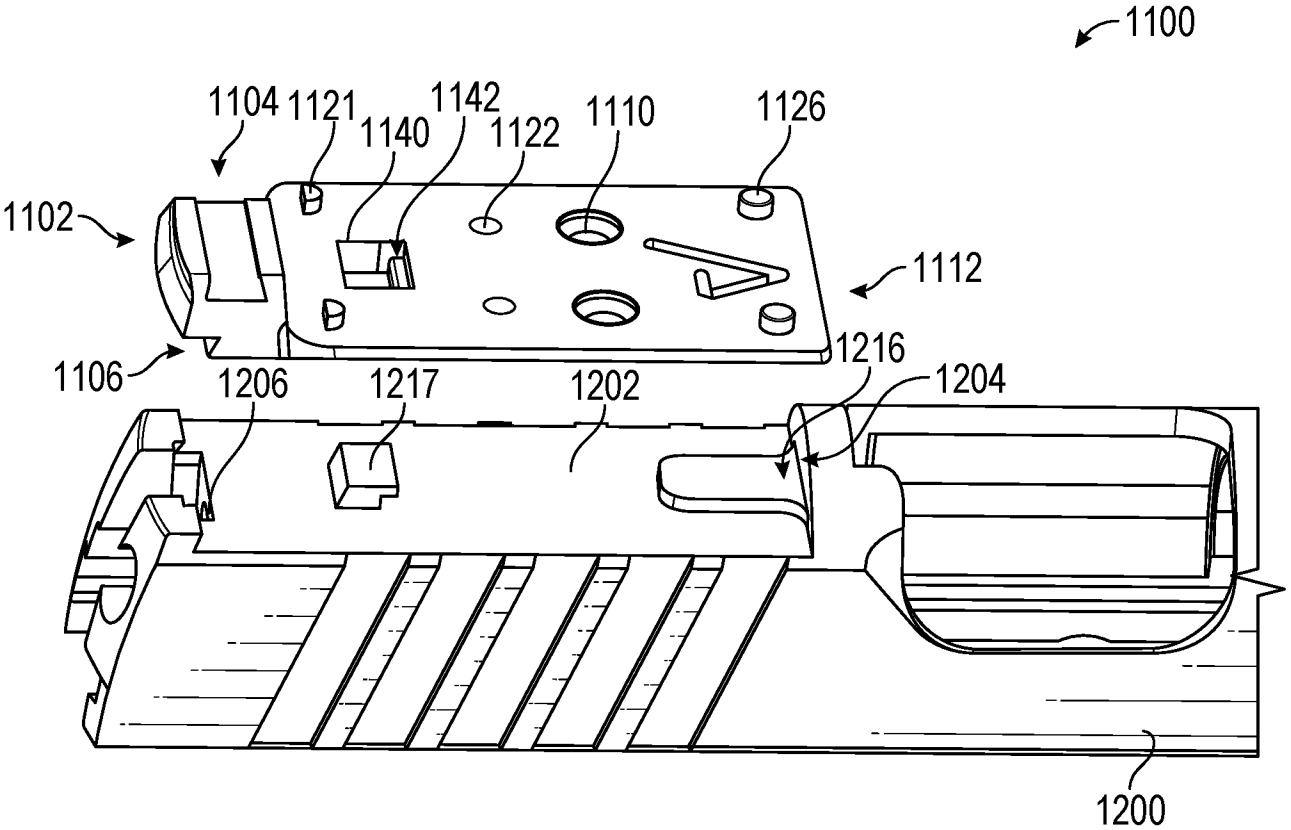
FIG. 14 is a perspective view of the mounting plate and slide with a latch and hook system according to one or more examples in the disclosure.
Figure 15:
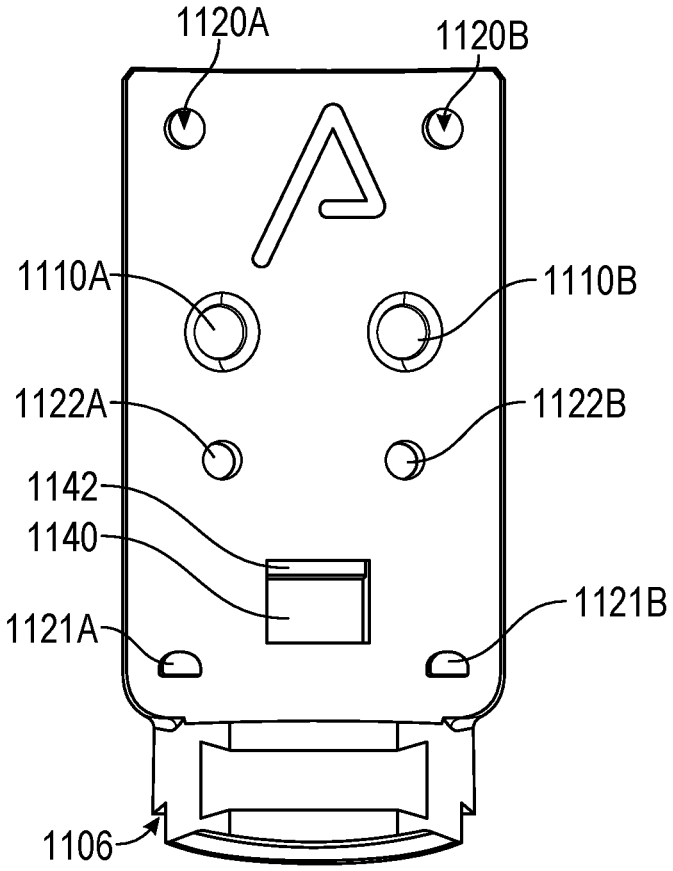
FIG. 15 is a top view of the mounting plate with a latch according to one or more examples in the disclosure.
Figure 16:
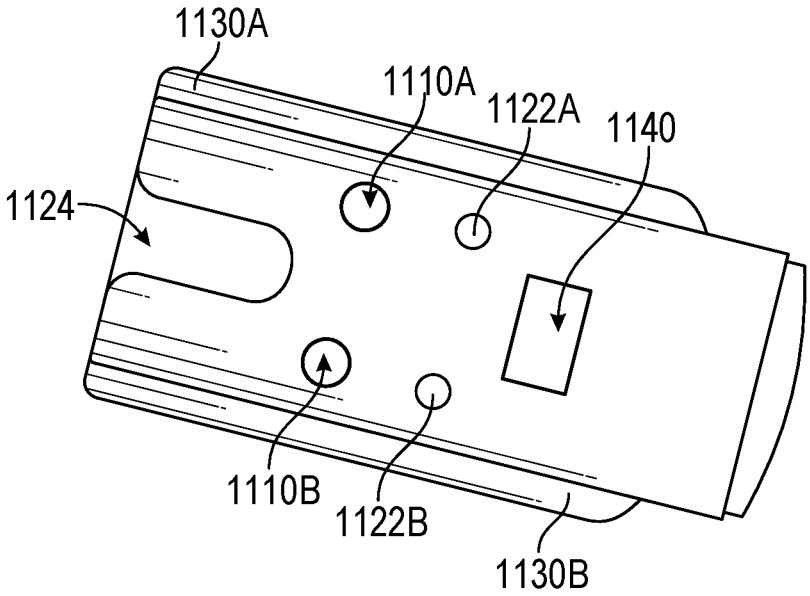
FIG. 16 is a bottom view of the mounting plate with a latch according to one or more examples in the disclosure.

Referring to FIGS. 14-16, a firearm slide has a recess configured to accept a mounting plate. In certain examples, the firearm slide includes an exterior surface with a front side and a back side. On a top side of the firearm slide, between the front side and the back side, the recess 402 is disposed towards the second back side. The recess can be a recessed surface along the plane of the top side of the firearm slide.

The recess 1202 of the firearm slide includes slide walls (e.g., a first slide wall 1204 at a front of the recess and a second slide wall 1206 at a rear of the recess) disposed opposite to one another. Extending from a second slide wall 1206 can be a rib 1216 disposed within the recess. The rib 1216 can run between the first slide wall 1204 and edge of the slide. The rib 1216 can be a raised surface from a recess base surface configured to correspond to a surface of a mounting plate. In other examples, the rib 1216 may extend in a variety of other directions and/or take other shapes, such as a square, circle, triangle, etc., or a combination shape. The recess base surface can comprise a hook 1217 configured to latch onto a catch 1142 on the mounting plate through an aperture 1140. In some examples, the second slide wall 1206 can form a dovetail slot, which mates with the dovetail ridge 1106 of the mounting plate. The front surface 1112 of the mounting plate and the first slide wall 1204 of the slide can be substantially perpendicular to the surface of the slide recess. In some examples, the sockets 1222 can be disposed throughout and adjacent to the recess. The sockets 1222 can be configured to receive one or more fasteners (e.g., threaded). The firearm plate mounting assembly can alter between a disengaged position and an engaged position. In the disengaged position, the mounting plate 1100 (or any mounting plate embodiment shown or described herein) can lower into the recess to secure onto the slide. The mounting plate can include an optic base surface with engagement components such as a sight joint 1104, one or more tabs 1121 (also referred to as 1121A, 1121B), apertures 1110 (also referred to as 1110A, 1110B), and bosses 1120 (also referred to as 1120A, 1120B)disposed thereon. In one example, the sight joint 1104 is disposed adjacent to the rear side 1102, opposite the front side. The sight joint 1104 can be shaped like a dovetail sight joint and thereby secure a complementing iron sight. The optic base surface can have one or more bosses 1120. The boss 1120 can be hollow and include an aperture to thereby receive a fastener. That is, the boss 1120 can extend from the top surface to the bottom surface of the mounting plate. In some examples, the fastener may extend through the optic (not shown) through the boss 1120, and into the firearm slide socket once the mounting plate is set onto the firearm slide. In other examples, the boss 1120 may not have an aperture. The bottom surface 1126 of the mounting plate 1100 may further have a channel 1124 to correspond to the rib 1216 of the slide 1200, as well as wings 1130A, 1130B on the right and left sides of the mounting plate 1100. The channel 1124 may extend from the front side 1112 of the mounting plate. The channel 1124 can be substantially the same size and width of the rib 1216. The wings 1130A, 1130B may be thinner than the rest of the mounting plate 1100 and allow for easy grip and removal of the mounting plate 1100 by grabbing the sides.

Figure 17:
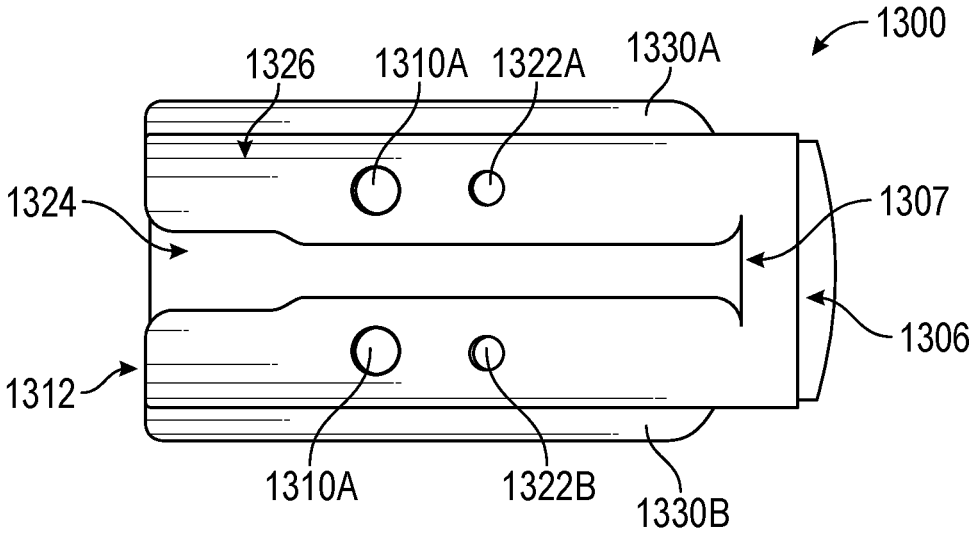
FIG. 17 is a bottom view of the slide with a channel according to one or more examples in the disclosure.
Figure 18:
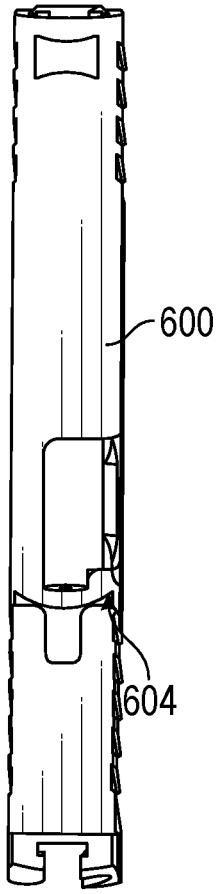
FIG. 18 is a top view of the slide with a dovetail cut according to one or more examples in the disclosure.
Figure 19:
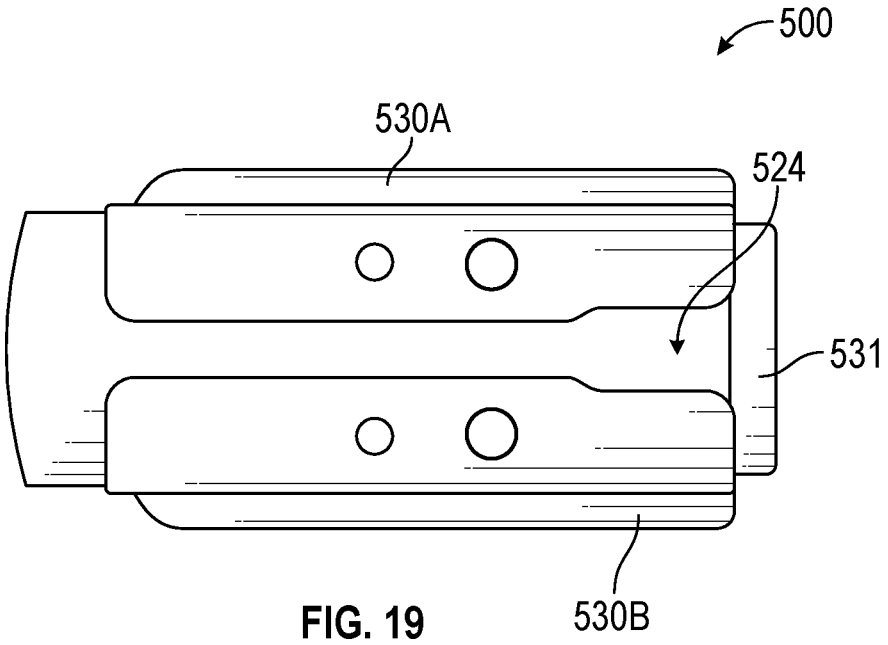
FIG. 19 is a bottom view of the slide according to one or more examples in the disclosure.

Referring to FIG. 17, a bottom surface 1326 of a firearm mounting plate 1300 is shown. The bottom surface 1326 of the mounting plate 1300 may further have a channel 1324 to correspond to the rib of the slide, as well as wings 1330A, 1330B on the right and left sides of the mounting plate 1300. The channel 1324 may extend from the front side 1312 of the mounting plate to a point 1307 short of the ridge 1306. The channel 1324 may further be variable or change in width to accompany the rib of the slide, or to accompany multiple different types of ribs. The wings 1330A, 1330B may be thinner than the rest of the mounting plate 1300 and allow for easy grip and removal of the mounting plate 1300 by grabbing the sides.

Although specific examples of the disclosure have been described, numerous other modifications and alternative examples are within the scope of the disclosure. For example, any of the functionality described with respect to a particular device or component may be performed by another device or component. Further, while specific device characteristics have been described, examples of the disclosure may relate to numerous other device characteristics. Further, although examples have been described in language specific to structural features and/or methodological acts, it is to be understood that the disclosure is not necessarily limited to the specific features or acts described. Rather, the specific features and acts are disclosed as illustrative forms of implementing the examples. Conditional language, such as, among others, "can," "could," "might," or "may," unless specifically stated otherwise, or otherwise understood within the context as used, is generally intended to convey that certain examples could include, while other examples may not include, certain features, elements, and/or steps. Thus, such conditional language is not generally intended to imply that features, elements, and/or steps are in any way required for one or more examples.

We claim:

1. A firearm sight mounting plate assembly, comprising:
a firearm slide comprising:
a recess disposed on a top side of the firearm slide, the recess comprising:
a first slide wall at a front of the recess, a second slide wall at a rear of the recess, and a recessed surface extending between the first slide wall and the second slide wall; and
a rib extending along the recessed surface between the first slide wall and the second slide wall; and
a mounting plate comprising:
a top surface, a bottom surface, a front side, and a rear side;
a sight joint comprising:
a first plate wall;
a channel extending from the front side of the mounting plate on the bottom surface of the mounting plate, the channel comprising:
a first channel portion having a first constant channel width along at least a majority of the first channel portion; and
a second channel portion having a second constant channel width along at least a majority of the second channel portion, the second constant channel width being less than the first constant channel width; and
a ridge extending between the bottom surface of the mounting plate and the sight joint.

2. The firearm sight mounting plate assembly of claim 1, wherein the sight joint is above the top surface of the mounting plate.

3. The firearm sight mounting plate assembly of claim 1, wherein the ridge is a dovetail, and wherein the second slide wall is a dovetail slot.

4. The firearm sight mounting plate assembly of claim 1, wherein the ridge is a vertical wall.

5. The firearm sight mounting plate assembly of claim 1, wherein the firearm slide further comprises a firearm slide socket, wherein the mounting plate further comprises a mounting plate socket on the top surface of the mounting plate, and wherein the firearm slide socket and the mounting plate socket are configured to be aligned.

6. The firearm sight mounting plate assembly of claim 5, wherein the mounting plate further comprises:
one or more bosses extending from the top surface of the mounting plate; and
one or more apertures extending through the top surface to the bottom surface of the mounting plate.

7. The firearm sight mounting plate assembly of claim 1, wherein the first slide wall of the recess comprises a dovetail slot, and wherein the mounting plate further comprises a dovetail disposed on the front side of the mounting plate.

8. The firearm sight mounting plate assembly of claim 1, wherein the channel extends from the front side of the mounting plate to the ridge.

9. The firearm sight mounting plate assembly of claim 8, wherein the rib comprises:
a first rib portion having a first constant rib width along at least a majority of the first rib portion, the first rib portion configured for being received within the first channel portion;
a second rib portion having a second constant rib width along at least a majority of the second rib portion, the second constant rib width being less than the first constant rib width, and the second rib portion configured for being received within the second channel portion.

10. The firearm sight mounting plate assembly of claim 9, wherein the rib has a first portion extending from the first slide wall.

11. The firearm sight mounting plate assembly of claim 1, wherein the first channel portion extends from the front side of the mounting plate, and wherein the channel further comprises a transition portion disposed between the first channel portion and the second channel portion and along which a width of the channel transitions from the first constant channel width to the second constant channel width.

12. The firearm sight mounting plate assembly of claim 1, wherein the rib extends only partially between the first slide wall and the second slide wall.

13. A firearm sight mounting plate assembly, comprising:
a firearm slide comprising:
a recess disposed on a top side of the firearm slide, the recess comprising:
a first slide wall at a front of the recess, a second slide wall at a rear of the recess, and a recessed surface extending between the first slide wall and the second slide wall;
a rib extending along the recessed surface between the first slide wall and the second slide wall; and
a hook disposed on the recessed surface; and
a mounting plate comprising:
a top surface, a bottom surface, a front side, and a rear side;
an aperture extending from the top surface to the bottom surface of the mounting plate, the aperture comprising a catch disposed within the aperture;
a sight joint comprising:
a first plate wall;
a channel extending from the front side of the mounting plate on the bottom surface of the mounting plate; and
a ridge extending between the bottom surface of the mounting plate and the sight joint.

14. The firearm sight mounting plate assembly of claim 13, wherein the mounting plate further comprises:

one or more bosses extending from the top surface of the mounting plate;

one or more apertures extending through the top surface to the bottom surface of the mounting plate; and one or more sockets extending through the top surface to the bottom surface of the mounting plate.

15. The firearm sight mounting plate assembly of claim 14, wherein the ridge is a dovetail, and wherein the second slide wall of the recess is a dovetail slot.

16. A method of manufacturing a firearm sight mounting plate assembly, the method comprising providing:

a firearm slide;

a recess disposed on a top side of the firearm slide, the recess comprising:

a first slide wall at a front of the recess, a second slide wall at a rear of the recess, and a recessed surface extending between the first slide wall and the second slide wall;

a rib extending along the recessed surface between the first slide wall and the second slide wall;

a mounting plate, comprising:

a top surface, a bottom surface, a front side, and a rear side;

a sight joint disposed on the rear side of the mounting plate;

a first plate wall disposed on the front of the sight joint;

a channel extending from the front side of the mounting plate on the bottom surface of the mounting plate, the channel comprising:

a first channel portion having a first constant channel width along at least a majority of the first channel portion; and a second channel portion having a second constant channel width along at least a majority of the second channel portion, the second constant channel width being less than the first constant channel width; and a ridge extending between the bottom surface of the mounting plate and the sight joint.

17. The method of manufacturing a firearm sight mounting plate assembly of claim 16, wherein the sight joint is disposed above the top surface of the mounting plate.

18. The method of manufacturing a firearm sight mounting plate assembly of claim 16, wherein the ridge is a dovetail, and wherein the second slide wall is a dovetail slot.

19. The method of manufacturing a firearm sight mounting plate assembly of claim 16, further comprising:

providing a dovetail on the front side of the mounting plate; and providing a dovetail slot on the first slide wall.

20. The method of manufacturing a firearm sight mounting plate assembly of claim 16, wherein the first channel portion extends from the front side of the mounting plate, and wherein the channel further comprises a transition portion disposed between the first channel portion and the second channel portion and along which a width of the channel transitions from the first constant channel width to the second constant channel width.

* * * * *